US009358414B2

(12) United States Patent
Dephouse

(10) Patent No.: US 9,358,414 B2
(45) Date of Patent: Jun. 7, 2016

(54) ROTATOR CUFF THERAPY DEVICE

(71) Applicant: Link A. Dephouse, Spring Lake, MI (US)

(72) Inventor: Link A. Dephouse, Spring Lake, MI (US)

( * ) Notice: Subject to any disclaimer, the term of this patent is extended or adjusted under 35 U.S.C. 154(b) by 776 days.

(21) Appl. No.: 13/668,695

(22) Filed: Nov. 5, 2012

(65) Prior Publication Data

US 2013/0116605 A1 May 9, 2013

Related U.S. Application Data

(60) Provisional application No. 61/557,674, filed on Nov. 9, 2011.

(51) Int. Cl.
*A63B 21/015* (2006.01)
*A63B 21/06* (2006.01)
(Continued)

(52) U.S. Cl.
CPC ..... *A63B 21/0004* (2013.01); *A63B 21/00061* (2013.01); *A63B 21/0608* (2013.01);
(Continued)

(58) Field of Classification Search
CPC ..... A63B 23/1254; A63B 21/00003; A63B 21/0032; A63B 21/0004; A63B 21/00061; A63B 21/00069; A63B 21/00072; A63B 21/00076; A63B 21/00094; A63B 21/00101; A63B 21/00109; A63B 21/00116; A63B 21/0012; A63B 21/00123; A63B 21/00127; A63B 21/0013; A63B 21/012; A63B 21/0125; A63B 21/015; A63B 21/0608; A63B 21/0615; A63B 21/072; A63B 21/0724; A63B 21/0726; A63B 21/0728; A63B 21/075; A63B 21/08; A63B 21/1446; A63B 21/1465; A63B 21/1469; A63B 21/1476; A63B 21/1484; A63B 21/1488; A63B 21/1492; A63B 21/1496; A63B 21/15; A63B 21/159; A63B 21/22; A63B 21/225; A63B 21/227; A63B 2021/0616; A63B 2021/0617; A63B 2021/0722; A63B 2021/222; A63B 22/0002; A63B 22/0015; A63B 22/0023; A63B 22/18; A63B 2022/0005; A63B 2022/0017; A63B 2022/0028; A63B 23/035; A63B 23/03508; A63B 23/03516; A63B 23/03633; A63B 23/03541; A63B 23/12; A63B 23/1209; A63B 23/1245; A63B 23/1263; A63B 23/1272; A63B 23/1281; A63B 2071/0694; A63B 23/1236; A61H 1/003; A61H 1/02; A61H 1/0274; A61H 1/0281; A61H 2001/0203; A61H 2001/0207; A61H 2201/12; A61H 2201/1215; A61H 2201/1253; A61H 2201/1261; A61H 2201/1269; A61H 2201/1284; A61H 2201/14; A61H 2201/1427; A61H 2201/1445; A61H 2201/1454; A61H 2201/1463; A61H 2201/1661; A61H 2201/1671; A61H 2201/1673; A61H 2205/062
USPC ..... 482/115
See application file for complete search history.

(56) References Cited

U.S. PATENT DOCUMENTS 2,414,063 A 1/1947 Rogers
2,832,334 A * 4/1958 Whitelaw ..... 601/33
(Continued)

FOREIGN PATENT DOCUMENTS

JP 2005278840 A 10/2005

*Primary Examiner* — Oren Ginsberg
*Assistant Examiner* — Gary D Urbiel Goldner
(74) *Attorney, Agent, or Firm* — Gardner, Linn, Burkhart & Flory, LLP

(57) ABSTRACT

A rotator cuff therapy device assists a user in accomplishing orbital motion of the user's arm to provide a therapeutic effect that strengthens and rehabilitates the arms, shoulders, and related joints and tissues. The device may be adjustable so that an unevenly-weighted rotatable portion can be moved along a desired path with varying speed and effort according to a pre-selected friction setting, and while being held in different positions relative to the user's body. This allows the device to be used by people with varying degrees of dexterity, strength, or injury, while targeting different tissues for therapy.

20 Claims, 4 Drawing Sheets

(51) Int. Cl.

| | |
|---|---|
| ***A63B 21/00*** | (2006.01) |
| ***A63B 21/072*** | (2006.01) |
| ***A63B 21/22*** | (2006.01) |
| ***A63B 23/035*** | (2006.01) |
| ***A63B 23/12*** | (2006.01) |
| *A63B 71/06* | (2006.01) |

(52) U.S. Cl.

CPC ..... *A63B21/072* (2013.01); *A63B 21/22* (2013.01); *A63B 21/4035* (2015.10); *A63B 21/4043* (2015.10); *A63B 23/03508* (2013.01); *A63B 23/1245* (2013.01); *A63B 21/015* (2013.01); *A63B 2071/0694* (2013.01)

(56) References Cited

U.S. PATENT DOCUMENTS

| | | | | | |
|---|---|---|---|---|---|
| 3,467,373 | A | * | 9/1969 | Justice | 472/22 |
| 3,495,824 | A | * | 2/1970 | Cuinier | 482/113 |
| 4,043,553 | A | * | 8/1977 | Suarez | 482/110 |
| 4,436,303 | A | * | 3/1984 | McKillip et al. | 482/118 |
| 4,632,391 | A | | 12/1986 | Orak | |
| 4,768,778 | A | * | 9/1988 | Thomas, Jr. | 482/141 |
| 4,772,015 | A | * | 9/1988 | Carlson et al. | 482/92 |
| 4,858,912 | A | * | 8/1989 | Boyd | 482/45 |
| 4,905,994 | A | * | 3/1990 | Hartz | 482/146 |
| 5,147,262 | A | | 9/1992 | Hymanson | |
| 5,478,297 | A | * | 12/1995 | Dennis, Jr. | 482/82 |
| 5,674,162 | A | | 10/1997 | Ellingson et al. | |
| 5,683,337 | A | * | 11/1997 | Zetocha et al. | 482/146 |
| 5,788,618 | A | * | 8/1998 | Joutras | 482/114 |
| 5,954,621 | A | * | 9/1999 | Joutras et al. | 482/114 |
| 5,980,435 | A | * | 11/1999 | Joutras et al. | 482/114 |
| 6,736,766 | B1 | * | 5/2004 | Gallant | 482/114 |
| 7,329,212 | B2 | | 2/2008 | Roque | |
| 7,503,884 | B1 | * | 3/2009 | Schall | 482/141 |
| 7,553,267 | B1 | * | 6/2009 | Hauser et al. | 482/141 |
| D597,153 | S | | 7/2009 | Friedman et al. | |
| 7,686,740 | B1 | | 3/2010 | Chang | |
| 7,896,789 | B2 | | 3/2011 | Hinton et al. | |
| 7,909,746 | B2 | | 3/2011 | Gant | |
| 7,935,039 | B2 | | 5/2011 | Dannenberg | |
| 2004/0266593 | A1 | * | 12/2004 | Schwendeman | 482/140 |
| 2005/0096200 | A1 | | 5/2005 | Amann | |
| 2006/0014615 | A1 | | 1/2006 | Godbold | |
| 2006/0040809 | A1 | * | 2/2006 | Godbold | 482/141 |
| 2007/0184951 | A1 | * | 8/2007 | James et al. | 482/141 |
| 2008/0108918 | A1 | * | 5/2008 | Joutras et al. | 601/34 |
| 2008/0200318 | A1 | * | 8/2008 | Hauser et al. | 482/141 |
| 2008/0305935 | A1 | * | 12/2008 | Sanghavi | 482/91 |
| 2010/0317496 | A1 | * | 12/2010 | Abranchess | 482/141 |
| 2011/0065555 | A1 | * | 3/2011 | Moskowich | 482/141 |

* cited by examiner

ROTATOR CUFF THERAPY DEVICE

CROSS REFERENCE TO RELATED APPLICATION

The present application claims the benefit of U.S. provisional application, Ser. No. 61/557,674, filed Nov. 9, 2011, which is hereby incorporated herein by reference in its entirety.

FIELD OF THE INVENTION

The present invention relates to physical therapy devices for exercising and treating the arms, shoulders, and related joints and tissues.

BACKGROUND OF THE INVENTION

Orbital or circular motion of a person's arm has been found to provide therapeutic effects for the shoulder joint, rotator cuff, and associated muscles and connective tissues.

SUMMARY OF THE INVENTION

The present invention provides a rotator cuff therapy device that is grasped in a user's hand and moved by the user in a circular or orbital motion, typically with the arm outstretched from the body. The device includes a pendulum or weighted portion that traverses a circular path along the device, about a rotational axis, when the user moves the device at a predetermined rate (frequency) and displacement. However, because different users have different levels of strength, coordination, degrees of injury, and susceptibility to further injury, and since those traits would be expected to change for a given user throughout a therapy program, the device is adjustable so that the pendulum or weighted portion can be moved along the desired path with varying speed and effort applied by the user.

For example, the device can be adjusted for use by those with relatively low arm strength so that the weighted portion of the device will move along its circular path with minimal effort and speed, and can further be adjusted for use by those with greater arm strength so that the weighted portion of the device will move along its circular path only with increased effort by the user. Optionally, the weighted portion may be spaced further from the axis of rotation so that the weighted portion will tend to move more slowly for a given level of effort, while tracing a larger orbital or generally circular path.

In one form of the present invention, a therapy device includes a base member, a rotatable member, and a friction member all coupled together. The base member is grasped by a user, and may have a gripping portion or handle provided for that purpose. The rotatable member is rotatably coupled to the base member and has an uneven weight distribution so that its momentum can be used to rotate it via orbital motion of the base member. A friction member is coupled to either or both of the base member and the rotatable member, and is configured to resist rotation of the rotatable member relative to the base member. The rotatable member is configured to be rotatably driven via orbital movement of the base member, which movement may be inhibited or slowed by the friction member.

According to one aspect, either or both of the rotatable member and the base member are generally disk-shaped. Where the rotatable member is generally disk-shaped, it optionally may include a radial projection providing the uneven weight distribution. The radial projection may be configured to receive one or more additional weights.

According to another aspect, the friction member is adjustable to permit different levels of resistance to rotation of the rotatable member, relative to the base member. Optionally, the friction adjustment member is adjustable to a limited or discrete number of friction settings, to provide two or more predetermined levels of frictional resistance to rotation of the rotatable member.

According to still another aspect, the rotatable member includes a plurality of indicia along a rear surface of the rotatable member, and the friction adjustment member includes an indicator that aligns with the indicia to provide a visual indication of a selected one of the indicia corresponding to one of the limited number of friction settings. Optionally, the indicator is an opening defined by the friction adjustment member, and acts as a viewing window to indicate the indicia corresponding to the selected friction setting.

According to a further aspect, one of the rotatable member and the friction adjustment member includes a recessed surface defined between a pair of end walls. The other of the rotatable member and the friction adjustment member includes a projection that is positioned between the end walls and is circumferentially movable between the end walls to limit the rotation of the friction adjustment member relative to the rotatable member.

According to a still further aspect, the friction adjustment member includes a generally helical ramped front surface that engages a rear surface of the rotatable member. The rear surface of the rotatable member may include a generally helical ramped rear surface that is engaged by the generally helical ramped front surface of the friction adjustment member. The helical ramped surfaces engage and interact so that rotation of the friction adjustment member in one direction relative to the rotatable member causes the rotatable member to compress against the base member, and so that rotation of the friction adjustment member in the opposite direction causes the rotatable member to release compression against the base member.

Optionally, a bushing is positioned between the base disk and the rotatable disk, so that the bushing can be compressed between the base disk and the rotatable disk when the friction adjustment member is rotated relative to the rotatable disk, to thereby increase the frictional resistance to relative rotation between the bushing and at least one of the base disk and the rotatable disk.

Thus, the present invention provides a rotator cuff therapy device that is configured to aid a user in accomplishing a therapeutic orbital motion of either arm in order to strengthen and rehabilitate the arms, shoulders, and related joints and tissues. The device may be adjustable so that a pendulum or weighted portion can be moved along a desired path with varying speed and effort applied by the user. This allows the device to be used by people with varying degrees of dexterity, strength, or injury, and the device may be adjusted to increase the effort required by the user as the joint(s) and muscles are progressively strengthened.

These and other objects, advantages, purposes and features of the present invention will become apparent upon review of the following specification in conjunction with the drawings.

DESCRIPTION OF THE PREFERRED EMBODIMENTS

Figure 1:
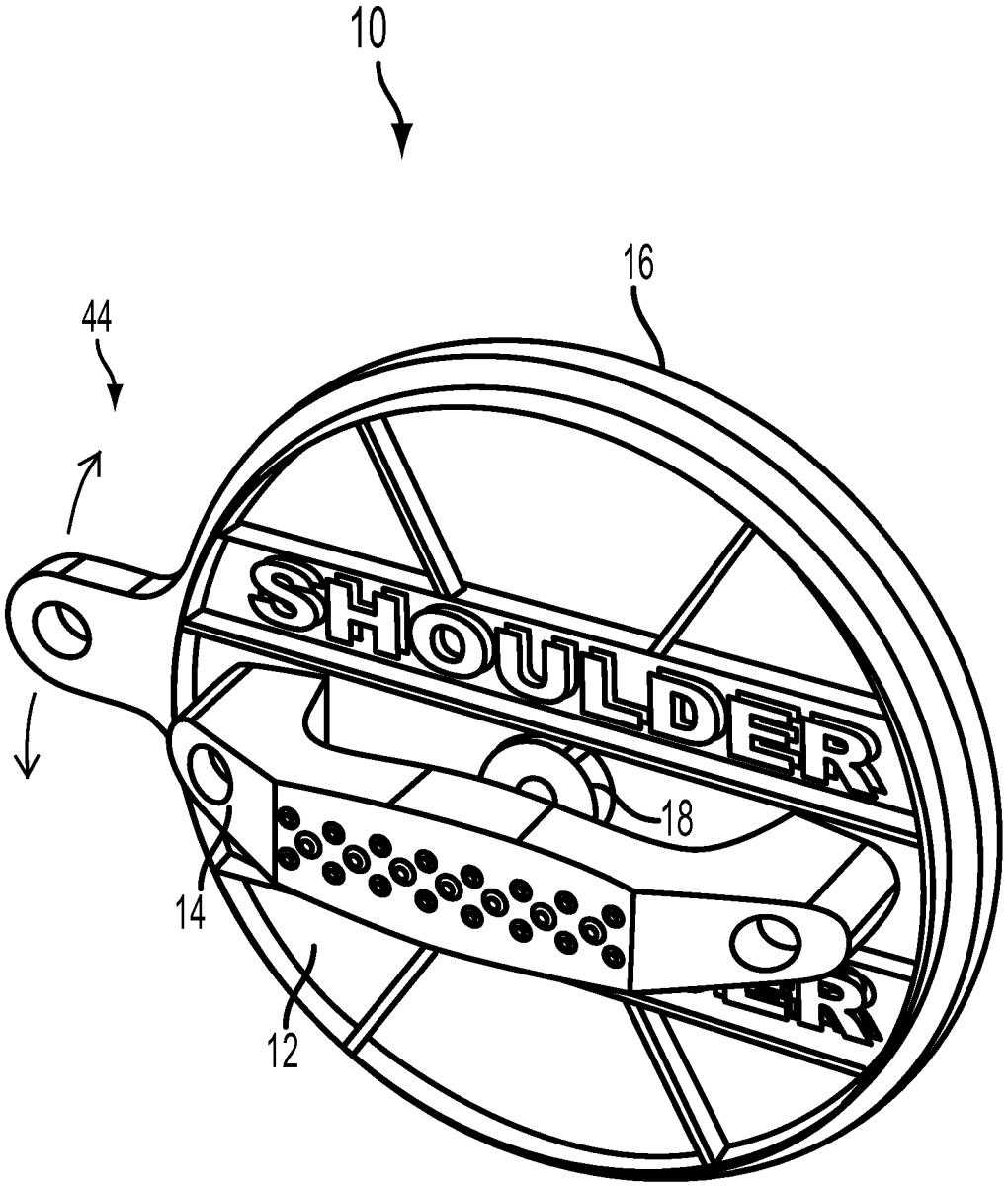
FIG. 1 is a perspective view of a rotator cuff therapy device in accordance with the present invention.
Figure 2:
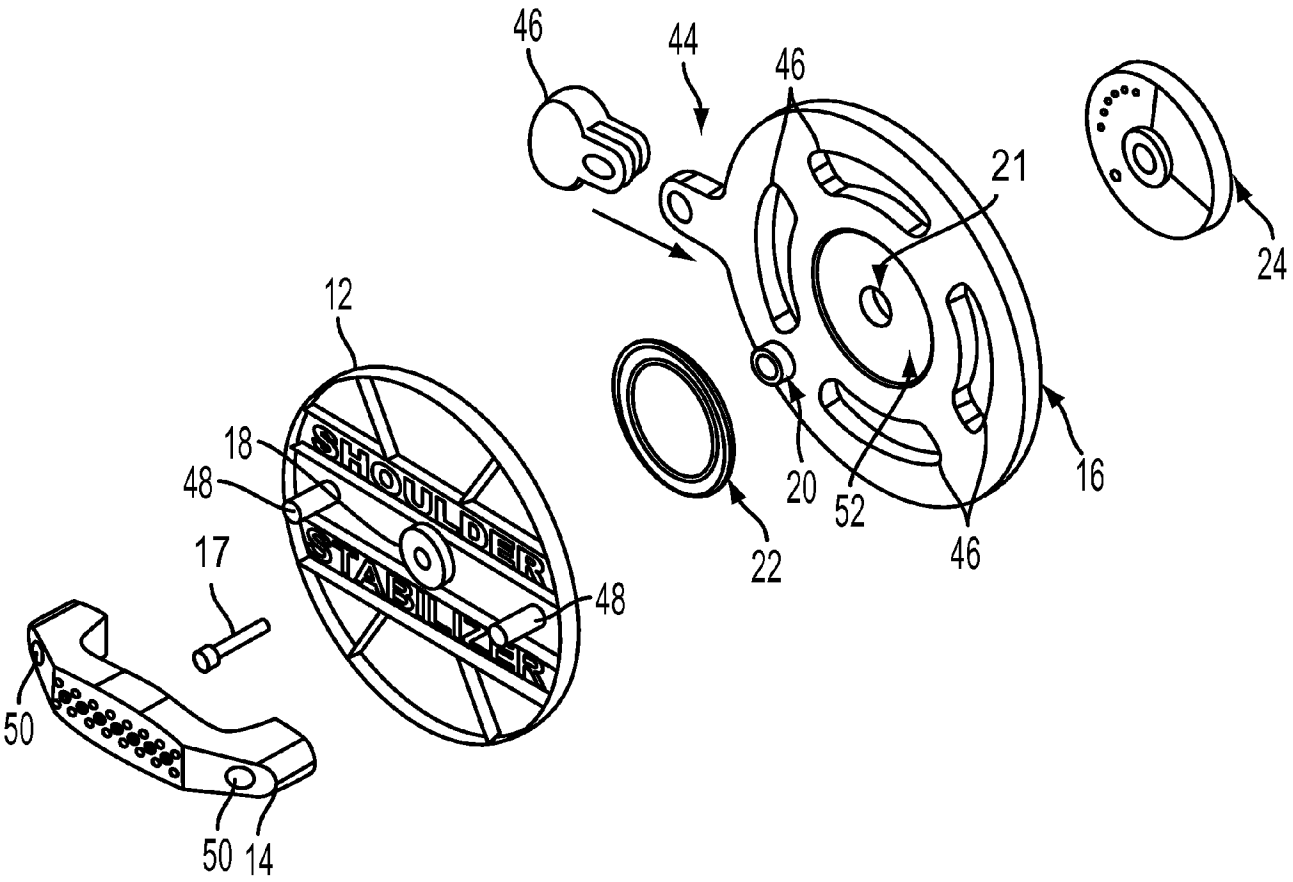
FIG. 2 is an exploded perspective view of the rotator cuff therapy device of FIG. 1.

Referring now to the drawings and the illustrative embodiments depicted therein, a rotator cuff therapy device 10 includes a base disk 12 to which a handle 14 and an unevenly-weighted rotatable disk 16 are attached (FIGS. 1 and 2). Disk 16 is rotatably coupled to the base disk 12 by a shaft or bolt 17 that passes through a flange 18 on base disk 12, and that continues through a bushing or ball bearing 20 mounted in an opening 21 formed in the center of the rotatable disk 16, such as shown in FIG. 2. A flat bushing 22 is disposed between the rotatable disk 16 and the base disk 12 to facilitate smooth rotation and to provide frictional engagement between the rotatable disk 16 and base disk 12. A tension or friction-adjustment disk 24 is mounted to the rotatable disk 16, opposite the base disk 12, and is rotatably adjustable to change the degree of frictional resistance to rotation of the rotatable disk 16 relative to the base disk 12.

Figure 3:
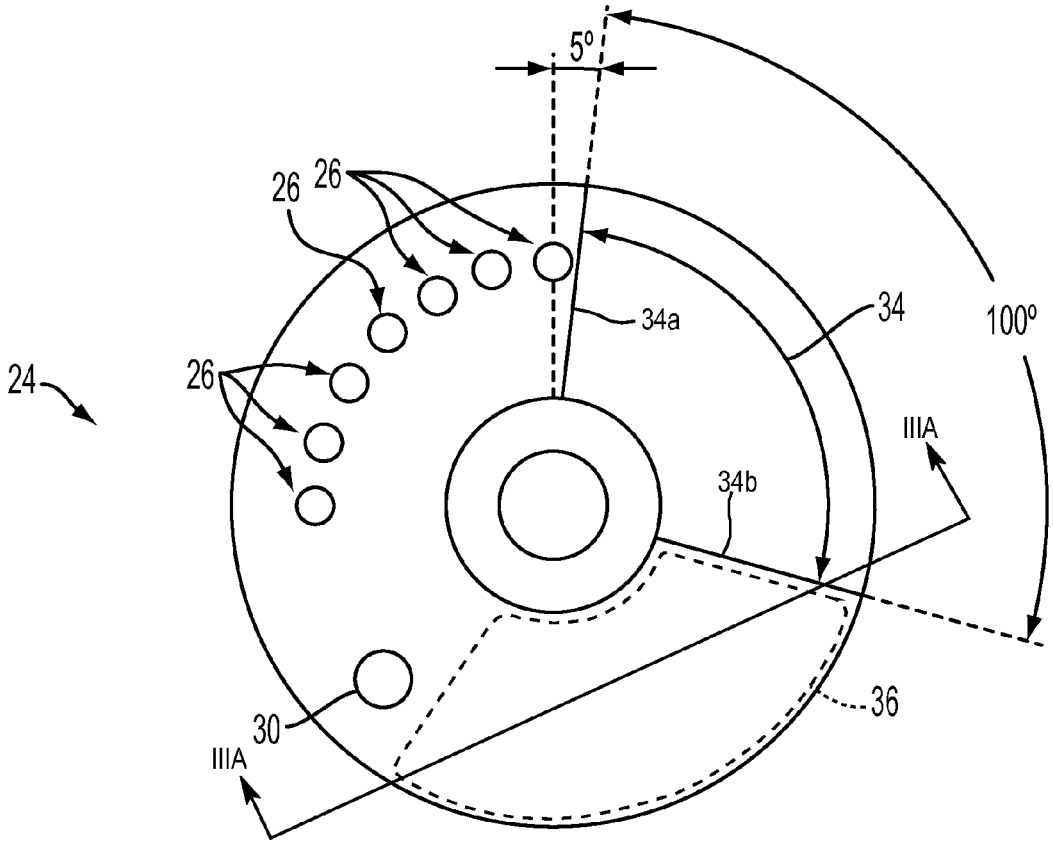
FIG. 3 is a front elevation of the front surface of the friction adjustment disk shown in FIG. 2.

As best shown in FIG. 3, friction adjustment disk 24 includes a plurality of through-holes 26 (seven holes are shown) that are spaced radially from the center of disk 24 and spaced circumferentially from one another. Through-holes 26 act as detents (also referred to herein as "detent holes") and are selectively engaged by a projection or raised portion 28 formed in the front surface of rotatable disk 16 (FIG. 4), as will be described below. Optionally, it will be appreciated that dimples or recesses or blind holes may be used in place of detent-holes 26, without departing from the spirit and scope of the present invention. Another through-hole in friction adjustment disk 24 forms a viewing window 30 that is spaced circumferentially from the detent-holes 26, and aligns with indicia 32 (FIG. 4) that are provided on the rotatable disk 16. Thus, viewing window 30 acts as an indicator by providing the user with a view of one of the indicia 32 corresponding to a given level of friction or resistance to rotation, as will be described below in more detail. It will be appreciated that the terms "front" and "rear" (and similar) are used herein to provide a frame of reference to facilitate an understanding of the device, but such terms are not intended to be limiting in any way.

Figure 3A:
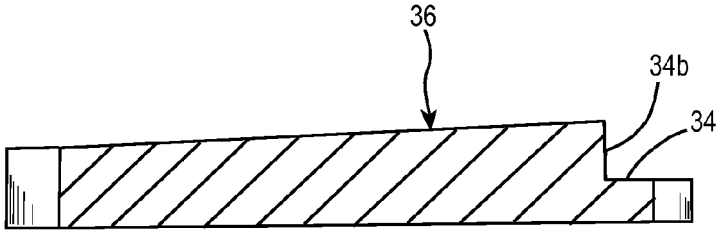
FIG. 3A is a side sectional view taken along section line IIIA-IIIA of FIG. 3.
Figure 4:
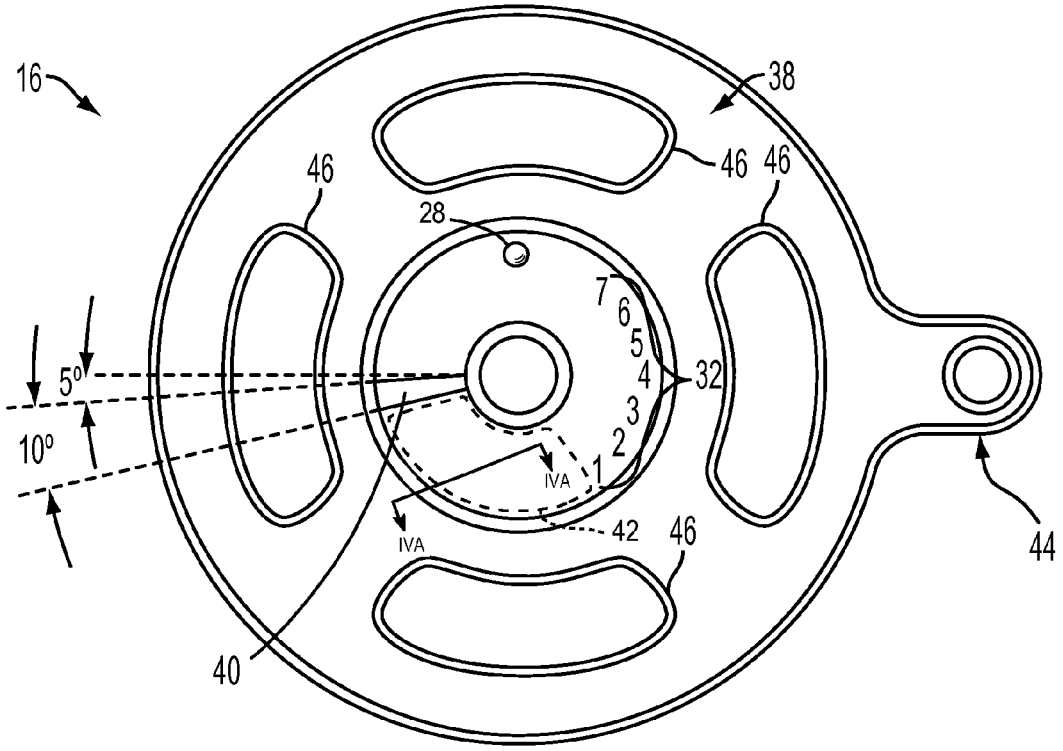
FIG. 4 is a front elevation of the rear surface of the rotatable disk of the rotator cuff therapy device of FIG. 1.

Friction adjustment disk 24 includes a reduced-thickness region 34 (FIGS. 3 and 3A) that is defined between a pair of radially-aligned end walls 34*a*, 34*b*. Reduced-thickness region 34 receives a projection in the form of a radially-aligned ridge 40 that extends from a rear face 38 of rotatable disk 16 (FIG. 4), so that the rotation of the friction adjustment disk 24 relative to the rotatable disk 16 is limited by ridge 40 contacting end walls 34*a*, 34*b* when therapy device 10 is assembled. In the illustrated embodiment, end walls 34*a*, 34*b* are circumferentially spaced apart by about 100°, so that friction adjustment disk 24 can rotate less than about 100° relative to rotatable disk. The actual limit of rotation by friction adjustment disk 24 relative to rotatable disk 16 may be calculated by subtracting the thickness of ridge 40 (which may correspond to about 10° as shown in FIG. 4, for example) from the circumferential spacing of end walls 34*a*, 34*b* (which is about 100° in the illustrated embodiment). Thus, in the illustrated embodiment, friction adjustment disk 24 can rotate about 90° relative to rotatable disk 16, and the first and last detent-holes 26 are correspondingly spaced apart by about 90°, so that each detent hole 26 corresponds to about 15° of rotation of friction adjustment disk 24.

Rotatable disk 16 includes a rear face 38 (FIG. 4) with indicia 32 in the form of sequential numbers spaced at 15° intervals corresponding to the spacing of detent holes 26, in the illustrated embodiment. One of the indicia 32 is typically viewable through the viewing window 30 in the friction adjustment disk 24 when therapy device 10 is assembled in the manner shown in FIG. 1. A raised projection or bump 28 extends or projects at least slightly from rear face 38 so that the projection 28 engages one of the detent-holes 26 in friction adjustment disk 24 when the device is assembled, with ridge 40 positioned somewhere between end walls 34*a*, 34*b* in the reduced-thickness region 34. Viewing window 30 aligns with one of the indicia 32 when projection 28 is seated in one of the detent holes 26. This provides an indexing or detent function, whereby the projection 28 is received in one of the seven detent holes 26 corresponding to the indicia number 32 that is viewable through viewing window 30.

Figure 4A:
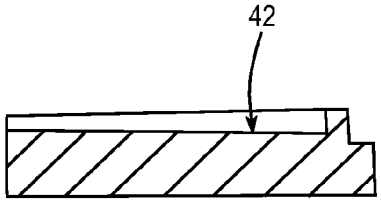
FIG. 4A is a side sectional view taken along section line IVA-IVA of FIG. 4.

Friction adjustment disk 24 further includes a circumferentially or partial-helically ramped portion or region 36 (FIGS. 3 and 3A) in which the thickness of the friction adjustment disk 24 changes around the disk's circumference, as in a portion of a spiral-shaped ramp. Similarly, and with reference to FIGS. 4 and 4A, rear face 38 includes a partial-helically ramped surface 42 (i.e. rotatable disk 16 varies in thickness circumferentially around inner portion 42, as in a semi-helical manner). This allows ramped surface 42 of rotatable disk 16 to engage the helically ramped surface 36 of friction adjustment disk 24, so that friction adjustment disk 24 may be urged into tighter or looser engagement with rotatable disk 16 as the surfaces 36, 42 engage one another to varying degrees depending on their rotational position relative to one another.

As friction adjustment disk 24 is rotated into tighter engagement with rotatable disk 16 via the interaction of ramped surfaces 36, 42, the flat bushing 22 is squeezed more tightly between rotatable disk 16 and base disk 12. In the illustrated embodiment, friction adjustment disk 24 is rotated counter-clockwise relative to rotatable disk 16 when viewed from behind (i.e., opposite from the front views of FIGS. 1-3) to provide increasing compression and friction, and is rotated in the opposite direction to provide reduced compression and friction. This interaction of ramped surfaces 36, 42 increases the frictional resistance to rotation of rotatable disk 16 relative to base disk 12.

During use of therapy device 10 in which the device is moved orbitally and rotatable disk 16 spins relative to base disk 12, friction adjustment disk 24 remains in a fixed position relative to rotatable disk 16 due to engagement of projection 28 with one of detent holes 26, so that friction adjustment disk 24 and rotatable disk 16 turn or rotate together relative to base disk 12 during such use. Thus, when the rotator cuff therapy device 10 is assembled, the friction adjustment disk 24 can be manually grasped by one hand of the user, while rotatable disk 16 is grasped in the other, and the friction adjustment disk 24 rotated relative to rotatable disk 16 to set the desired friction between the rotatable disk 16 and base disk 12.

Although the embodiment that is shown and described herein provides seven predetermined rotational positions of friction adjustment disk 24, with corresponding indicia that provide a clear indication of the current "friction setting," it will be appreciated that a greater or fewer number of detents may be provide, or none at all, while still permitting the user to adjust the friction setting in substantially the same manner described above. It is further envisioned that, optionally, the friction between the rotatable disk and the base disk may be changed via tightening of a threaded bolt or the like (such as bolt 17 having a nut or other fastener that tightens against the rear face of the rotatable disk), to press the rotatable disk more tightly against the base disk and increase the relative friction between the two, without departing from the spirit and scope of the present invention.

In the illustrated embodiment, a radial projection or "weight tab" 44 extends outwardly from the otherwise generally circular outer perimeter of the rotatable disk 16, and creates an uneven weight distribution of the rotatable disk 16 (FIGS. 1, 2, and 4). Additional weights 46 (FIG. 2) can be attached to the weight tab 44, if desired, such as to increase the effort required to cause the rotatable disk to rotate, or to reduce the speed of arm movement needed to rotate the rotatable disk 16. In addition, handle 14 is coupled to base disk 12 via mechanical fasteners 48, which may be threaded fasteners or studs, for example, which are received and secured in bores 50 that are formed or established in handle 14, such as shown in FIG. 2. Optionally, the handle may be attached to the base disk by an adhesive or an ultrasonic weld, or may be integrally or unitarily formed with the base disk. It is further envisioned that the therapy device could be readily adapted for use in exercising the leg and related joints and tissues by providing a strap or other attachment device that allows the therapy device to be attached to a user's foot, for example, and without departing from the spirit and scope of the present invention.

In use, the rotator cuff therapy device is grasped by handle 14, in the hand of a user's outstretched arm, and moved in a rapid orbital motion to cause the rotatable disk 16 to rotate or spin relative to the handle 14 and base disk 12 in either of two rotational directions, as indicated by curved arrows in FIG. 1. The user's arm may be moved to different positions relative to the user's body either prior to the orbital motion, or during the orbital motion. At reduced friction settings, the rotatable disk 16 more readily spins relative to the handle 14 and base disk 12, and thus requires less effort and muscle control to operate. At increased friction settings, the rotatable disk 16 will generally not spin without increased effort and muscle control to move it more quickly and/or through an orbital path having a larger diameter. Thus, the type and degree of therapy may be controlled by adjusting the friction of the rotatable disk 16 by setting the friction adjustment disk 24 at a desired position, and by changing the rate of orbital motion and the user's arm position.

Therefore, the present invention provides a rotator cuff therapy device that is adjustable so that a user may operate or use the device in a manner that requires different levels of arm strength, speed, and coordination. The device can be set at a minimum effort level for persons having low arm strength, for example, or for users who are just learning how to operate the device to provide therapeutic effect. The effort level can be increased as desired so that increasing levels of arm strength and speed are required to operate the device in a manner that still causes the rotatable disk to spin about its rotational axis, such as to provide greater therapy for those who are building strength and progressing along a therapy program.

Changes and modifications in the specifically described embodiments can be carried out without departing from the principles of the present invention, which is intended to be limited only by the scope of the appended claims, as interpreted according to the principles of patent law including the doctrine of equivalents.

The embodiments of the invention in which an exclusive property or privilege is claimed are defined as follows:

1. A therapy device for use in strengthening a user's rotator cuff via orbital arm motion, said therapy device comprising:

a base member having a centrally disposed handle configured to be grasped and supported by a user;

a rotatable member rotatably coupled to said base member, said rotatable member having an uneven weight distribution and defining a free end of said therapy device;

a friction member coupled to at least one of said base member and said rotatable member, said friction member configured to resist rotation of said rotatable member relative to said base member; and wherein said rotatable member is configured to be rotatably driven, relative to said base member, via orbital movement of said base member.

2. The therapy device of claim 1, wherein said centrally disposed handle is fixedly coupled to a first side portion of said base member, and wherein said rotatable member is rotatably coupled to an opposite second side portion of said base member.

3. The therapy device of claim 1, wherein said rotatable member and said base member are both generally disk-shaped.

4. The therapy device of claim 1, wherein said rotatable member is generally disk-shaped and includes a radial projection providing the uneven weight distribution.

5. The therapy device of claim 4, wherein said radial projection is configured to be coupled to an additional weight.

6. The therapy device of claim 1, wherein said friction member comprises a friction adjustment member that is adjustable to permit different levels of resistance to rotation of said rotatable member relative to said base member.

7. The therapy device of claim 6, wherein said friction adjustment member is adjustable to a limited number of friction settings to provide at least two predetermined levels of frictional resistance to rotation of said rotatable member relative to said base member.

8. The therapy device of claim 7, further comprising:

a plurality of indicia along a rear surface of said rotatable member; and an indicator along said friction adjustment member, said indicator configured to align with and provide a visual indication of a selected one of said indicia corresponding to one of the limited number of friction settings.

9. The therapy device of claim 8, wherein said indicator comprises an opening defined by said friction adjustment member, said opening configured to provide a viewing window to the selected one of said indicia.

10. The therapy device of claim 7, wherein one of said rotatable member and said friction adjustment member comprises a recessed surface defined between a pair of end walls, and wherein the other of said rotatable member and said friction adjustment member comprises a projection that is positioned between said end walls and circumferentially movable therebetween to limit the rotation of said friction adjustment member relative to said rotatable member.

11. The therapy device of claim 7, wherein said friction adjustment member comprises a generally helical ramped front surface that engages a rear surface of said rotatable member.

12. The therapy device of claim 11, wherein said rear surface of said rotatable member comprises a generally helical ramped rear surface that is engaged by said generally helical ramped front surface of said friction adjustment member.

13. The therapy device of claim 12, wherein said generally helical ramped rear surface of said rotatable member and said generally helical ramped front surface of said friction adjustment member are configured so that rotation of said friction adjustment member in a first direction relative to said rotatable member causes said rotatable member to compress against said base member, and so that rotation of said friction adjustment member in a second direction, opposite said first direction, causes said rotatable member to release compression against said base member.

14. The therapy device of claim 13, further comprising a bushing disposed between said base member and said rotatable member, wherein said bushing is compressed between said base member and said rotatable member when said friction adjustment member is rotated in the first direction relative to said rotatable member, to thereby increase the frictional resistance to relative rotation between said bushing and at least one of said base member and said rotatable member.

15. A therapy device for use in strengthening a user's rotator cuff via orbital arm motion, said therapy device comprising:

a base member configured to be supported by a user;

a gripping portion at said base member, said gripping portion configured to be grasped in a hand of the user, wherein said gripping portion includes a handle centrally disposed on a first side of said base member;

a rotatable member that is rotatably coupled to an opposing second side of said base member, said rotatable member having an uneven weight distribution;

a friction adjustment member coupled to one of said base member and said rotatable member, said friction adjustment member configured to selectively increase and decrease compression of said rotatable member against said base member to thereby increase and decrease the frictional resistance to rotation of said rotatable member relative to said base member; and wherein said rotatable member is configured to be rotatably driven, relative to said base member, via orbital movement of said base member.

16. The therapy device of claim 15, further comprising an annular bushing disposed between said base member and said rotatable member, wherein said annular bushing is configured to frictionally engage at least one of said base member and said rotatable member upon compression of said rotatable member against said base member.

17. The therapy device of claim 16, wherein said friction adjustment member is adjustable to a limited number of friction settings to provide at least two predetermined levels of frictional resistance to rotation of said rotatable member relative to said base member, said therapy device further comprising:

a plurality of indicia along a rear surface of said rotatable member; and an indicator along said friction adjustment member, said indicator configured to align with and provide a visual indication of a selected one of said indicia corresponding to one of the limited number of friction settings.

18. The therapy device of claim 17, wherein:

said friction adjustment member comprises a generally helical ramped front surface that engages a rear surface of said rotatable member;

said rear surface of said rotatable member comprises a generally helical ramped rear surface that is engaged by said generally helical ramped front surface of said friction adjustment member; and said generally helical ramped rear surface of said rotatable member and said generally helical ramped front surface of said friction adjustment member are cooperatively configured so that rotation of said friction adjustment member in a first direction relative to said rotatable member causes said rotatable member to compress against said base member and said annular bushing, and so that rotation of said friction adjustment member in a second direction, opposite said first direction, causes said rotatable member to release compression against said base member and said annular bushing.

19. The therapy device of claim 12, wherein one of said rotatable member and said friction adjustment member comprises a recessed surface defined between a pair of end walls, and wherein the other of said rotatable member and said friction adjustment member comprises a projection that is positioned between said end walls and circumferentially movable therebetween to limit the rotation of said friction adjustment member relative to said rotatable member.

20. A therapy device for use in strengthening a user's rotator cuff via orbital arm motion, said therapy device comprising:

a generally disk-shaped base member configured to be supported by a user;

a gripping portion at said base member, said gripping portion configured to be grasped in a hand of the user, wherein said gripping portion includes a handle centrally disposed on a first side of said base member;

a generally disk-shaped rotatable member that is rotatably coupled to an opposing second side of said base member, said rotatable member having an uneven weight distribution;

a bushing disposed between said base member and said rotatable member, wherein said bushing is configured to frictionally engage at least one of said base member and said rotatable member upon compression of said rotatable member against said base member;

an adjustable friction member coupled to one of said base member and said rotatable member, said adjustable friction member configured to selectively increase and decrease compression of said bushing between said base member and said rotatable member to thereby increase and decrease the frictional resistance to rotation of said rotatable member relative to said base member;

said adjustable friction member comprising a generally helical ramped front surface and being rotatably adjustable to a limited number of friction settings to provide at least two predetermined levels of frictional resistance to rotation of said rotatable member relative to said base member;

a rear surface of said rotatable member comprising a generally helical ramped rear surface that is engaged by said generally helical ramped front surface of said friction adjustment member;

a plurality of indicia along said rear surface of said rotatable member;

an indicator along said friction adjustment member, said indicator configured to align with and provide a visual indication of a selected one of said indicia corresponding to one of the limited number of friction settings;

wherein said rotatable member is configured to be rotatably driven, relative to said base member, via orbital movement of said base member; and wherein said generally helical ramped rear surface of said rotatable member and said generally helical ramped front surface of said friction adjustment member are cooperatively configured so that rotation of said friction adjustment member in a first direction relative to said rotatable member causes said rotatable member to compress against said base member, and so that rotation of said friction adjustment member in a second direction, opposite said first direction, causes said rotatable member to release compression against said base member.

* * * * *